US005268545A

United States Patent [19]

Bruner

[11] Patent Number: 5,268,545

[45] Date of Patent: Dec. 7, 1993

[54] LOW PROFILE TACTILE KEYSWITCH

[75] Inventor: David A. Bruner, Versailles, Ky.

[73] Assignee: Lexmark International, Inc., Greenwich, Conn.

[21] Appl. No.: 993,192

[22] Filed: Dec. 18, 1992

[51] Int. Cl.[5] ..... H01H 13/70

[52] U.S. Cl. ..... 200/345; 200/329; 200/344; 200/517; 200/521; 400/490; 400/491.2

[58] Field of Search ..... 200/341, 342, 344, 345, 200/517, 329, 520, 521, 327, 408, 409, 453, 454, 457, 43.11, 318.1, 318.2, 327, 276.1, 534; 400/496, 490, 491.1, 491, 491.2, 491.3, 495, 495.1

[56] References Cited

U.S. PATENT DOCUMENTS

| | | | |
|---|---|---|---|
| 3,624,332 | 11/1971 | Van Benshoten | 200/409 |
| 4,118,611 | 10/1978 | Harris | 200/67 A |
| 4,433,225 | 2/1984 | Cowles | 200/344 |
| 4,580,022 | 4/1986 | Oelsch et al. | 200/344 |
| 4,902,862 | 2/1990 | Oelsch et al. | 200/344 |
| 5,012,055 | 4/1991 | Matsui | 200/517 X |

FOREIGN PATENT DOCUMENTS

| | | | |
|---|---|---|---|
| 1424065 | 9/1988 | U.S.S.R. | 200/408 |
| 2057767 | 4/1981 | United Kingdom | 200/276.1 |

OTHER PUBLICATIONS

IBM Technical Disclosure Bulletin, vol. 17, No. 11, Apr. 1975, pp. 3377-3378, entitled "Low-Force Displacement Capacitor Actuator For Calico Keyboards" by R. H. Harris.

IBM Technical Disclosure Bulletin, vol. 31, No. 7, Dec. 1988, pp. 304-306, entitled "Keybutton Stabilizer" by D. A. Bruner.

*Primary Examiner*—Henry J. Recla
*Assistant Examiner*—Barrett Glen T.
*Attorney, Agent, or Firm*—John J. McArdle, Jr.

[57] ABSTRACT

A low profile tactile keyswitch including a horizontally positioned elastic column spring which buckles under an axial load to provide a tactile feel for the keyswitch. The ends of the spring are maintained between two spring holders which are urged together as the keybutton is depressed. Stabilizing arms pivotally attached to the keybutton are used to stabilize the keybutton and also to carry extensions which engage the spring holders to move them together as the keybutton is depressed. The keyswitch is operable to be placed in an inactive configuration in which the keybutton is lowered without placing the spring under added compression.

9 Claims, 5 Drawing Sheets

LOW PROFILE TACTILE KEYSWITCH

BACKGROUND OF THE INVENTION

One generally accepted type of keyswitch for typewriters and computer keyboards is referred to as a tactile keyswitch. Tactile keyswitches provide a crisp tactile force and acoustic response when depressed by an operator. Such tactile keyswitches can be constructed in various ways.

One of the most widely utilized tactile keyswitch mechanisms is the "buckling spring" mechanism. As described in, for example, U.S. Pat. No. 4,118,611, a buckling spring keyswitch provides a non-teasible, snap-action, tactile feedback key mechanism featuring the use of a catastrophically buckling compression column spring.

This keyswitch mechanism is one of the most preferred for use in data entry keyboards. Because of the design of this mechanism in its current implementation, however, it is not well suited for very thin or low profile keyboard applications such as notebook computer products. Currently, buckling spring keyboards have a minimum thickness of about one inch.

Low profile notebook computer products typically specify keyboard thicknesses of less than one half inch. The thinnest "full travel" notebook keyboard product which is typical of what is in use in the keyboard industry has a thickness of 11 millimeters (0.433 inches). Keyboards are known which are of thicknesses as small as 8.4 millimeters (0.33 inches). Virtually all of these low profile keyboards utilize a pseudo-tactile rubber dome keyswitch mechanism.

The components of keyboard thickness are primarily keybutton height, keybutton travel and bearing length. The keybutton height for low profile keyboards is typically within a narrow range from 4 millimeters to 5 millimeters (0.16 inches to 0.2 inches). This is considered to be the minimum thickness for a keybutton in order for it to have good aesthetic characteristics. The keystroke, or travel, of keys in low profile keyboards is usually in the range of 2.0 millimeters to 3.3 millimeters (0.08 inches to 0.13 inches). The travel of keys in desktop keyboards where there is no thickness limitation, designated "full travel", has historically been 3.5 millimeters to 4.0 millimeters (0.14 inches to 0.16 inches). However, it is not uncommon to claim full travel for keyboards having a keystroke as small as 3.3 millimeters (0.13 inches). Keyboards which have little or no travel, less than 1 millimeter (0.04 inches), are usually considered insufficient for touch typing.

Referring to FIG. 1, an exemplary prior art low profile rubber dome keyswitch 11 for a low profile keyboard includes a keybutton 12 having a stem 13 received in a housing, or bearing 14. The keyboard thickness 16 is 11 millimeters, the keybutton height 17 is 4 millimeters, and the travel 18 is 2.5 millimeters.

For a given keybutton height and travel, the remaining limiting factor in reducing keyboard height is the bearing length of the keybutton bearing. In the present example, the bearing length 19 is 2.65 millimeters. The function of the bearing is to keep the keybutton top surface perpendicular to the direction of travel of the key as the keybutton is depressed. This function is referred to as stabilization. If the bearing is too short stabilization is degraded, and noticeable binding forces appear when the button is actuated at the periphery of the strike surface on the key top.

This bearing height limitation can be overcome through the use of more complex stabilization designs. One such design is a telescoping sleeve bearing which allows the bearing to collapse as the keybutton is depressed. This technique has been used to produce 9 millimeter (0.354 inches) thickness keyboards; but this technique seems to provide little hope for much additional height reduction. Another approach which is known to enable thinner constructions, at the expense of added complexity, is to employ stabilizing schemes already in use for long keybuttons, such as the space bar. These designs exist in many forms, but in general use pivoting arms or links to transfer the deflection motion of one end of the keybutton to the other end, thereby maintaining the proper orientation of the top surface of the keybutton.

It is an objective of the present invention to provide a tactile keyswitch for keyboards of the foregoing type which will provide a lower profile keyboard assembly than present pseudo-tactile rubber dome keyswitches.

In order to accomplish this, a keyswitch is provided which employs a horizontally positioned elastic column which buckles under an axial load to provide the tactile nature of the keyswitch mechanism. In a particular embodiment of the invention, a buckling spring serves as the elastic column and is placed horizontally rather than vertically in the tactile keyswitch mechanism.

In one form of the invention, the ends of the spring are constrained between two caps which are urged together as the keybutton is depressed. Stabilizing arms pivotally attached to the keybutton are used instead of a bearing to provide stabilization, and these stabilizing arms also carry extensions which engage the caps to move them together as the keybutton is depressed.

An exemplary form of the invention will now be described, in conjunction with the accompanying figures, in which:

DETAILED DESCRIPTION

Figure 1:
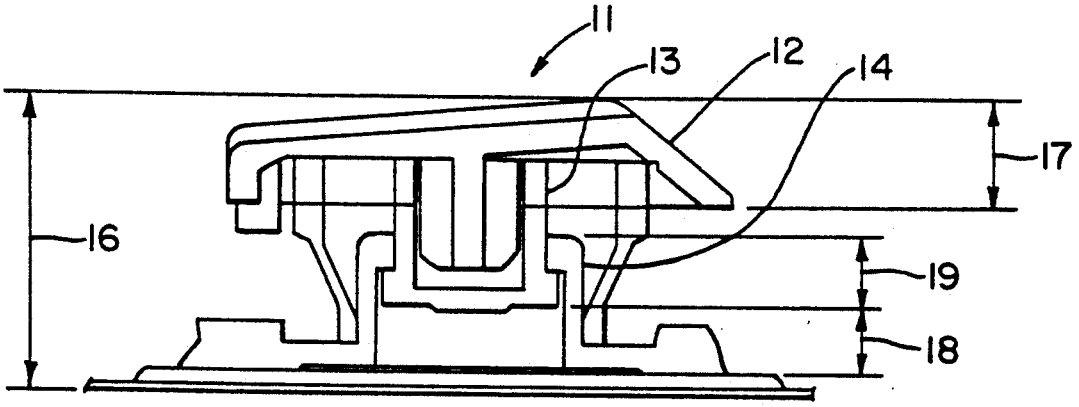
PRIOR ART fig. 1
FIG. 1 is a diagrammatic side view of a prior art rubber dome key structure.

With reference to the figures, and particularly FIGS. 2-5, in an exemplary embodiment of the invention, a helical compression column spring 21 is mounted horizontally in a key assembly 22. The ends of the spring 21 are held in spring holders 23, 24, which are acted upon by key top stabilization elements that include stabilization arms 28, 29. Extension pins 26, 27 from the stabilization arms 28, 29 serve to force the spring holders 23, 24 to swing toward one another as the keybutton, or key top, 31 is depressed. Forcing the spring holders together causes the spring to be compressed, and eventually to buckle.

The stabilization elements, in addition to stabilizing the keybutton as shall be described, function to convert the vertical motion of the keybutton to a horizontal motion which is needed to compress the horizontally-oriented spring 21. In this way, the force change from the deflected spring as it buckles is transferred back to the keybutton, providing a tactile keyswitch.

The geometry of the spring 21 and spring holders 23, 24 is such that the buckling of the spring is in a plane generally parallel to the plane of the base of the keyboard. The advantage of buckling in this plane is that the total thickness occupied by the spring is only its own thickness, regardless of whether the spring is in its buckled or unbuckled condition.

The spring holders 23 and 24 are substantially identical, being mirror images of one another. Considering one of the spring holders, the spring holder 23 for example, in more detail, the spring holder includes a spring-retaining portion 32 at the end of an arm portion 33 which terminates in a pivot post portion 34. The spring-retaining portion 32 includes a top wall 40 as well as a rear wall, which cooperate to form a "pocket" to hold the spring 21. An elongated stud 45 formed inside the side wall of the portion 32 limits movement of the end of the spring in the pocket. The pivot post 34 serves as the pivot point for rotation of the spring holder 23 in a horizontal plane as the spring-retaining portion 32 and a corresponding spring-retaining portion 30 (in the other spring holder 24) move toward one another when the key is depressed. Extending outwardly from the end of the spring-retaining portion 32 is a force-receiving tab 36 to which a force is applied by the pin 26 when the key is depressed. The pin 27 exerts a similar force on a tab 35 on the spring holder 24 when the key is depressed.

Figure 2:
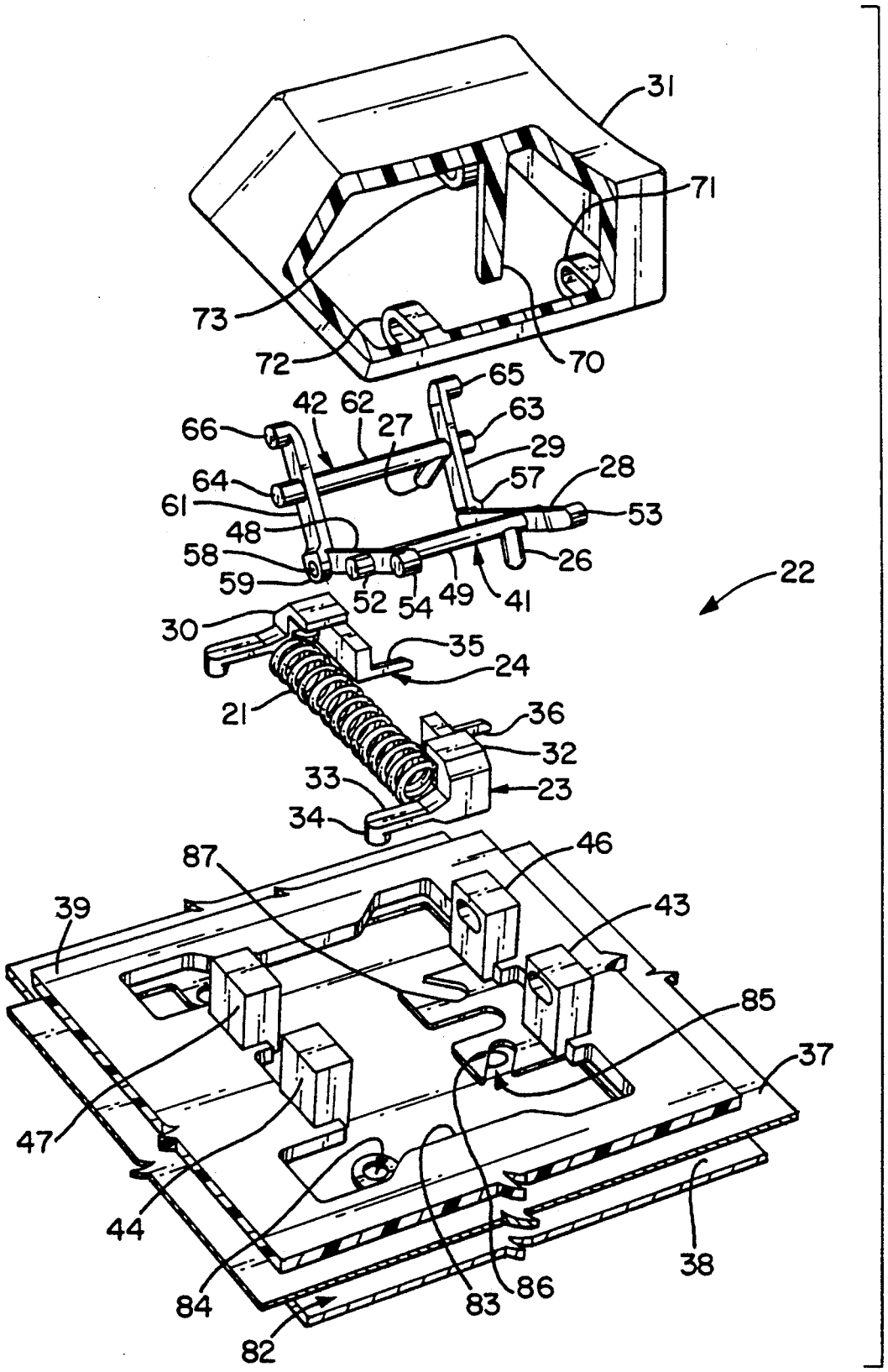
FIG. 2 is an exploded view of a key mechanism in accordance with the present invention.

The base of the keyboard includes, for present purposes, three layers: a bottom layer 38, a top layer 39 and a middle layer 37, which is movable relative to the other two layers. The spring holders 23, 24 are mounted for rotation in the moving layer 37 above the bottom layer 38 of the keyboard. The bottom layer of the keyboard contains, for each key assembly 22, a membrane switch (not shown), which is actuated in a manner to be described subsequently when the key is depressed. The layers 39 and 37 are apertured in the vicinity of the keybutton 31, while the bottom layer is substantially continuous, as best seen in FIG. 2.

The top layer 39 of the keyboard base is fixed above, and spaced apart from, the moving layer 37 to support stabilization elements 41 and 42, which include the stabilization arms 28, 29, respectively. The top layer 39 is suitably secured, for example, about the periphery of the keyboard, and also through slotted openings in the moving layer 37, to the bottom layer 38. For each key, the top layer includes two pairs of bearing elements 43, 44 and 46, 47 for the stabilizer elements 41, 42, respectively. The bearing elements are integrally formed with the top layer 39.

The stabilizer 41 includes the stabilization arm 28 and a stabilization arm 48, each of which is formed integrally with a cross member 49. There is an outwardly extending pin portion 51 (FIG. 5) in line with the cross member 49 on the stabilization arm 28, and there is an outwardly extending pin portion 52 similarly aligned on the stabilization arm 48. The pin portion 51 is received in the bearing 43 and the pin portion 52 is received in the bearing 44.

One end of the stabilization arm 28 includes an outwardly extending pin portion 53 which is retained for rotation and translation in a socket portion 71 located on the inside of the key cap 31. The stabilization arm 48 has at an end an outwardly extending pin portion 54 axially aligned with the pin portion 53 and received in another socket 72 in the key cap 31. At the other end of the stabilization arm 28, a pin portion 56 (FIG. 3) is received in a bearing portion 57 on the stabilization arm 29. Similarly, at the end of the stabilization arm 48 opposite the pin portion 54, is a pin portion 58 which is received in a bearing portion 59 on a stabilization arm 61, which is part of the stabilizer 42.

As in the case of the stabilizer 41, the stabilizer 42 includes a cross member 62. There is an outwardly extending pin portion 63 in line with the cross member 62 on the stabilization arm 29, and there is an outwardly extending pin portion 64 similarly aligned on the stabilization arm 61. The pin portion 63 is received in the bearing 46 on the top base layer 39, and the pin portion 64 is received in the bearing 47 on the top base layer 39. Each of the pin portions 51, 52, 63 and 64 is received for rotation and translation in an elongated oval channel in a different one of the bearings 43, 44, 46 and 47.

The stabilization arm 29 includes, at its end opposite the end carrying the bearing 57, an outwardly extending pin portion 65 which is retained for rotation and translation in a socket 73 inside the key cap 31. The stabilization arm 61 includes, at its end opposite the end forming the bearing 59, an outwardly extending pin portion 66 axially aligned with the pin portion 65 received on a socket 74 (FIG. 4) inside the key cap 31.

Each stabilizer 41 and 42 is integrally formed as a single plastic molded part. The two stabilizers are attached for pivoting relative to one another at the pin and socket connections 56, 57 and 58, 59. Also, the key cap 31 is a single molded part formed to include the sockets 71–74 located generally at lateral edges thereof and a downwardly extending post 70. The sockets 71–74 each have an elongated oval interior shape to permit rotation and translation of the pin portions therein. The post 70 is aligned with a membrane switch (not shown) in the bottom layer 38 of the base of the keyboard when the key cap is depressed.

Figure 3:
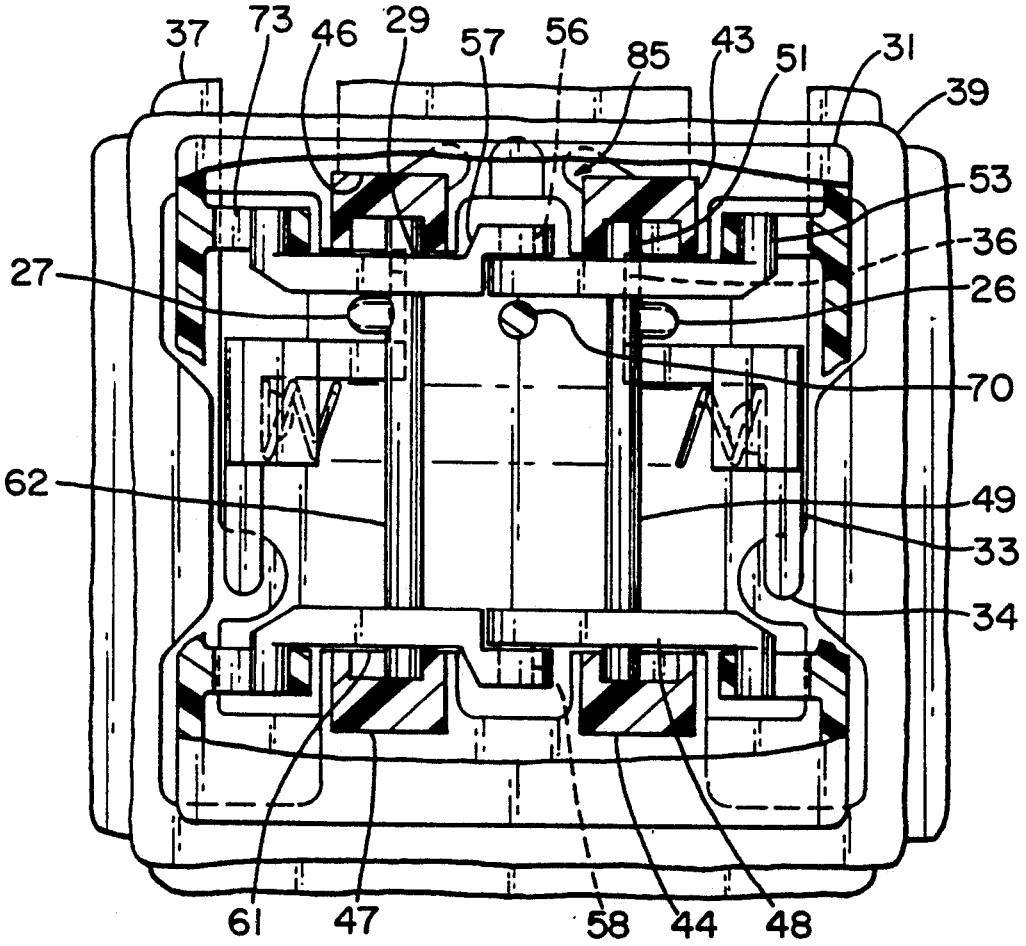
FIG. 3 is a top view, with portions removed, of the key mechanism of FIG. 2 with the key in its active configuration and the keybutton underpressed.
Figure 4:
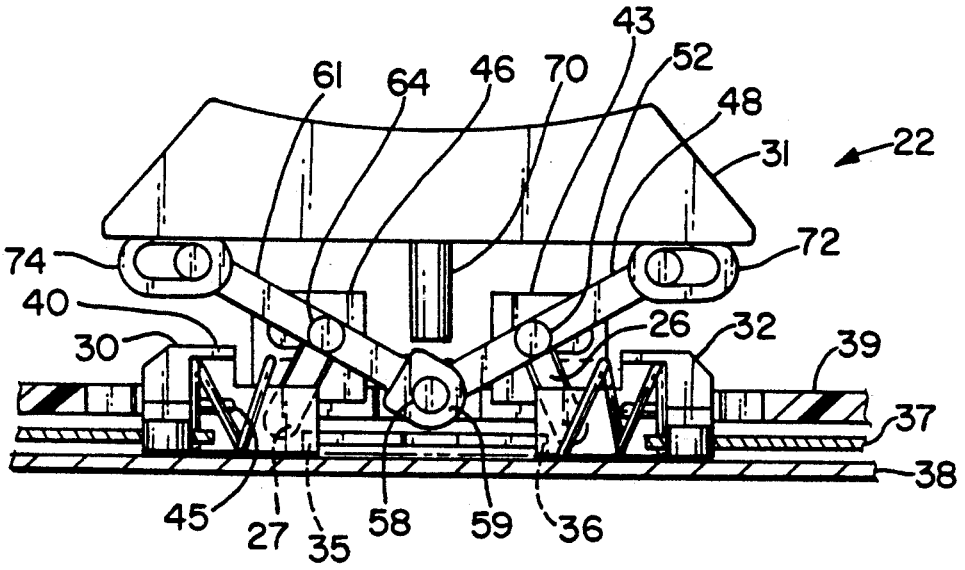
FIG. 4 is a front elevational view, with portions removed, of the key mechanism of FIG. 3.
Figure 5:
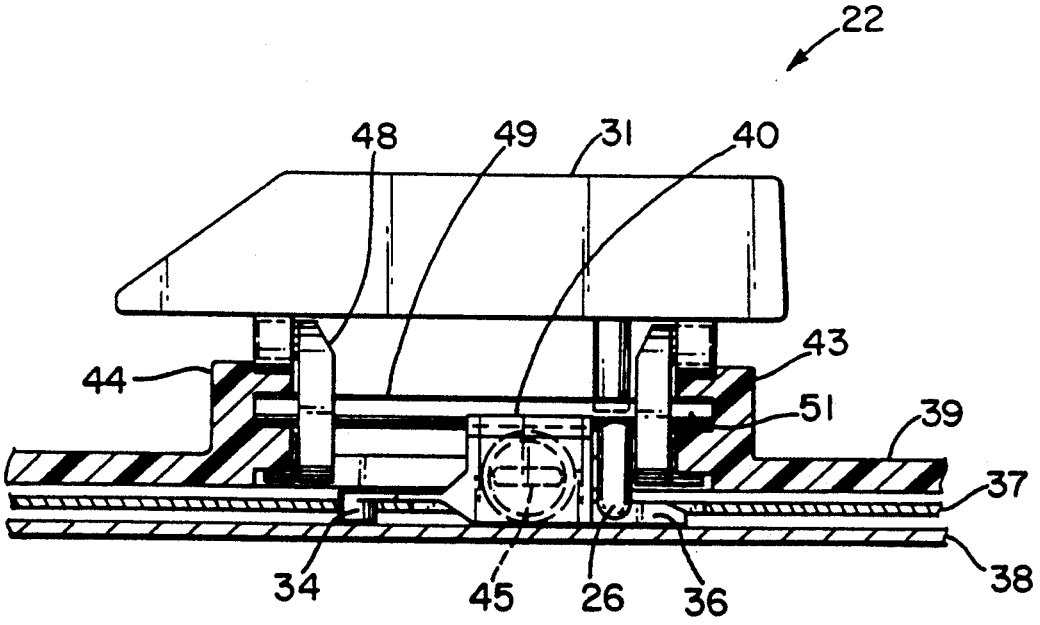
FIG. 5 is a side elevational view of the key mechanism of FIG. 3.

With continued reference to FIGS. 3–5, in the assembled key mechanism 22 the key cap 31 is supported and stabilized by the stabilizers 41 and 42, which are in turn supported on the bearings such as 43 and the spring holders such as 23. The key cap 31 is supported by the retention of the pins such as 53 in the sockets such as 71 and the stabilizer assembly (made up of the stabilizers 41 and 42) is supported by the retention of the pins such as 51 in the bearings such as 43. The key cap 31 is held in the upright position, as best shown in FIGS. 4 and 5, and the stabilizer assembly kept from collapsing, due to the resting of the extension pins 26 and 27 upon the tabs 35 and 36 on the spring holders 23 and 24. The tabs and spring holders are held apart by the partially compressed helical compression spring 21.

Figure 6:
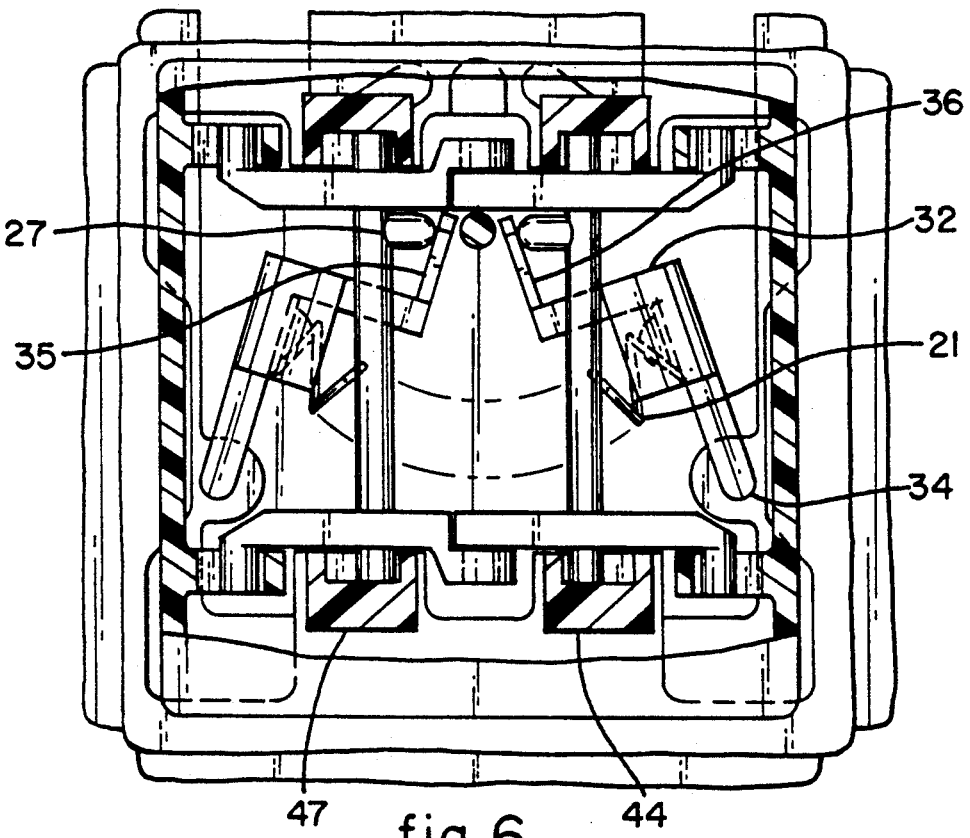
FIG. 6 is a top view, with portions removed, of the key mechanism of FIG. 2 in an active configuration with the keybutton depressed.

When the key cap 31 is depressed, the stabilizer joints 56, 57 and 58, 59 move upwardly and the extension pins 26, 27 swing inwardly forcing the spring holders 23 and 24 to rotate toward one another, compressing the spring 21. As the key is depressed, and the compression in spring 21 increases, the spring buckles (FIG. 6) providing tactile feedback to a person depressing the key. When the key is depressed, the post 70 passes through the openings in the layers 37 and 39 of the keyboard base, striking the bottom layer 38 and closing a membrane switch (not shown) in the bottom layer 38. When the key is released, the force of the spring 21 spreads the spring holders 23 and 24 apart, swinging the extension pins 26, 27 outwardly, returning the key to the orientation shown in FIGS. 4 and 5.

Each spring holder 23, 24 lies within openings in the upper two layers 39 and 37 of the keyboard base. The spring holder 23, for example, rests upon the top surface 82 of the bottom layer 38 of the base of the keyboard. The pivot post portion 34 of the spring holder 23 has a lower portion which extends through an aperture 84 in the middle layer 37 of the keyboard base in a manner to secure the spring holder for rotation about the pin portion 34. Outward rotational movement of each spring holder such as 23 is limited by a stop surface such as 83 formed along a portion of the inner wall of the opening in the top layer 39.

Figure 7:
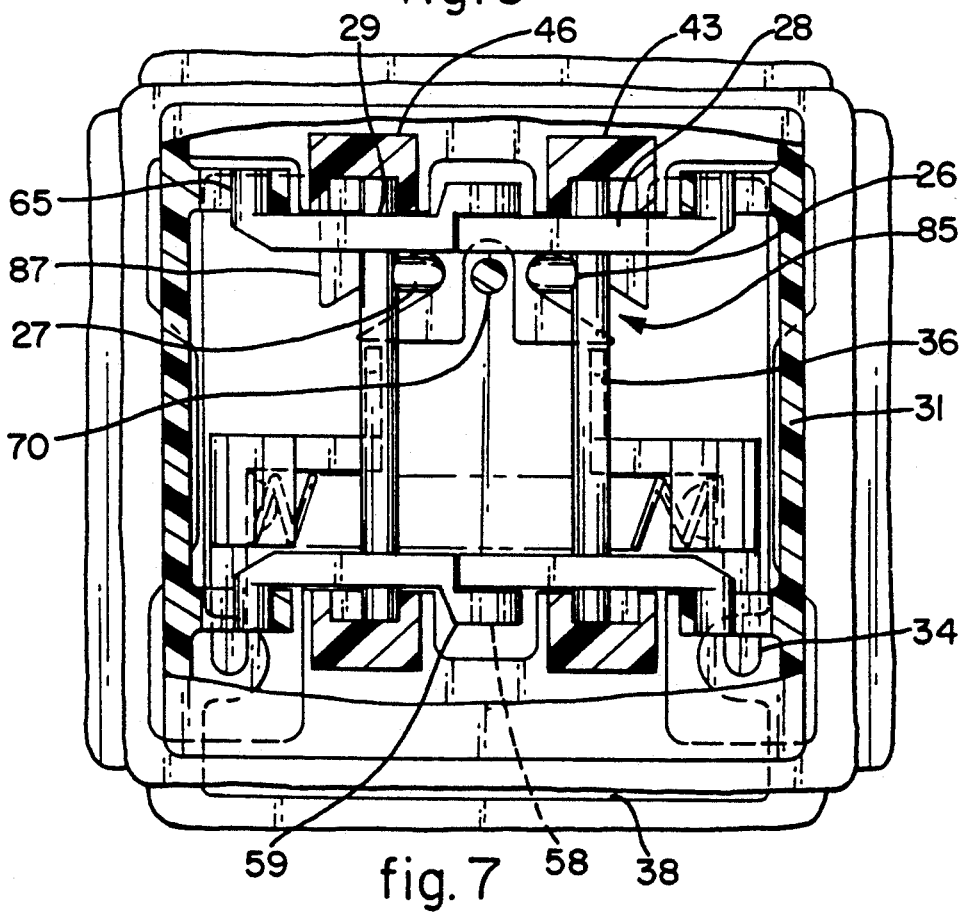
FIG. 7 is a top view, with portions removed, of the key mechanism of FIG. 2 in its inactive configuration.
Figure 8:
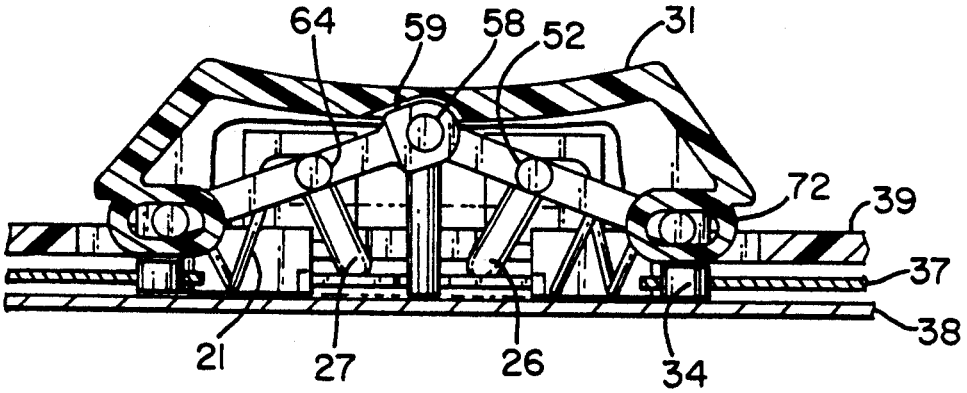
FIG. 8 is a front elevational view, with portions removed, of the key mechanism of FIG. 7.
Figure 9:
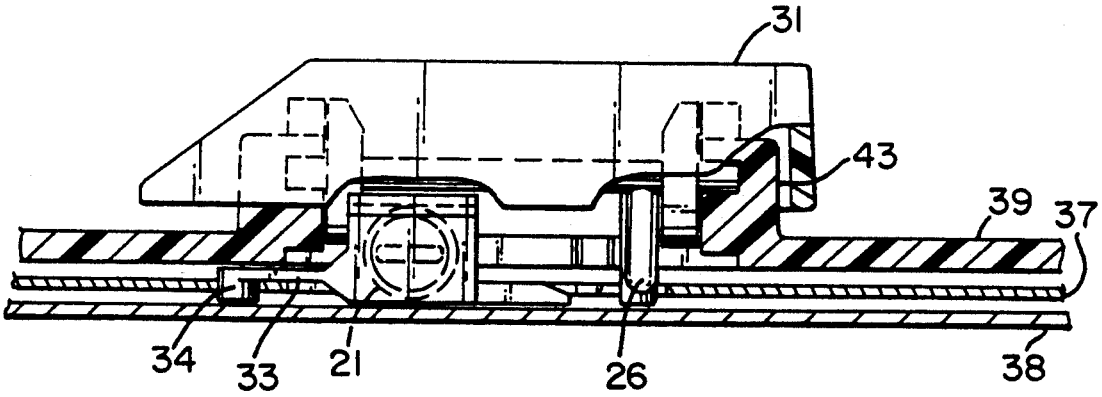
FIG. 9 is a side elevational view of the key mechanism of FIG. 7.

With additional reference to FIGS. 7–9, the middle layer 37 may be moved (downwardly as shown in FIG. 7) to permit the key mechanism 22 to be placed in an inactive, collapsed, low profile condition. This permits the keyboard to assume a low profile for storage without maintaining the springs 21 in a stressed, buckled condition.

Movement of the middle layer 37 relative to the fixed layers 38 and 39 (downwardly as viewed in FIG. 7 and to the left as viewed in FIG. 9) slides the tabs such as 36 from beneath the extension pins such as 26, allowing the stabilizer assembly 41, 42 to collapse. The extension pins such as 26 swing inwardly into openings such as 85 in a portion 87 of the moving layer 37 when the key mechanism 22 is placed in its inactive configuration.

When the moving layer 37 is moved in the other direction to return the key mechanism to an active configuration, each extension pin such as 26 rides along a cam surface such as 86 on one side of the opening 85 so that the extension pin is lifted back up onto the tab 36 to assume the active configuration.

In the illustrated form of the invention, the base layers 37, 38 and 39 have been shown with exaggerated spacings between the layers for purposes of illustration. The bottom layer 38, while shown as a single element for the purpose of illustrating the inventive key mechanism, would typically be an aluminum sheet with suitable overlays to provide membrane (or other) switches and conductive paths for the switches. It is presently contemplated that the spring 21 and the moving layer 37 would be metal and the remainder of the parts plastic, but changes and modifications to the parts and the materials used to form the parts may be made without departing from the spirit of the invention. For example, some parts making up the illustrated key mechanism which are shown as single components may be formed from two or more elements if desired to facilitate assembly of the key mechanism. Also, other switch actuation techniques beyond having the post 70 strike a membrane switch could be employed.

I claim:

1. A key mechanism comprising:

a key top;

an elastic column element, generally beneath the key top, which buckles under an axial load;

means, including a force-receiving surface, for holding the elastic column element under precompression in a first orientation and responsive to an applied force, on the force-receiving surface, to further compress the elastic column into a buckled condition;

and stabilizing means for supporting the key top including two pivoted stabilizing arms pivotally attached to the key top and to one another, movement of the key top in a direction generally perpendicular to the orientation of the elastic column element resulting in movement of portions of the pivoted arms, the stabilizing means further including at least one element coupled to a moving portion of a stabilizing arm which engages the force-receiving surface of the means for holding the elastic column element to apply a force to the means for holding the elastic column element to further compress the elastic column element into a buckled condition.

2. The key mechanism of claim 1 in which the elastic column element is a buckling compression spring and in which the means for holding the elastic column under precompression comprises a first spring holder receiving a first end of the compression spring and a second spring holder receiving a second end of the compression spring, at least one of the spring holders being movable toward the other spring holder in response to an applied force by said one element to further compress the spring into a buckled condition.

3. The key mechanism of claim 2 which includes a base and in which at least one of the spring holders is rotatably mounted on the base, permitting said spring holder to rotate in a direction toward the other spring holder.

4. A key mechanism comprising:

a key top;

an elastic column element;

means, including a force-receiving surface, for holding the elastic column element, generally beneath the key top, under precompression in a first orientation and responsive to an applied force on the force-receiving surface to further compress the elastic column element into a buckled condition;

a base lying in a plane generally beneath the elastic column element;

a first and a second stabilizing arm, the first stabilizing arm being pivotally attached at a first end to the key top near an edge thereof and the second arm being pivotally attached at a first end to the key top near another edge thereof, each arm being pivotally attached to the other at a second end;

and means for pivotally supporting each of the arms intermediate their ends in positions above the base, at least one said arm including an element contacting the force-receiving surface of the means for holding the elastic column under precompression so that downward movement of the key top results in application of a force to the force-receiving surface of the means for holding the elastic column element under precompression to further compress the elastic column element into a buckled condition.

5. The key mechanism of claim 4 in which the elastic column element is a buckling compression spring and in which the means for holding the spring under precompression includes a first spring holder and a second spring holder mounted on the base generally between the base and the key top.

6. A key mechanism comprising:

a key top;

a buckling compression spring;

means, including a force-receiving surface, for holding the spring under precompression generally horizontally in a first condition and responsive to an applied force on the force-receiving surface to further compress the spring into a buckled condition;

and means coupled to the key top for converting movement of the key top, in a generally vertical direction into a force applied to the force-receiving surface of the means for holding the spring, whereby the spring is further compressed into a buckled condition.

7. A key mechanism comprising:

a key top;

tactile feedback means, having a force-receiving surface, responsive to an applied force on the force-receiving surface for providing a variable resistance to said force;

stabilizing means for supporting the key top and including means for applying a force to the force-receiving surface of the tactile feedback means when the key top is depressed;

and means for changing the relative orientation between the stabilizing means and the tactile feedback means to an inactive relative orientation in which depression of the key top does not result in the application of said force to the force-receiving surface of the tactile feedback means.

8. The key mechanism of claim 7 in which the tactile feedback means is an elastic column element which buckles under an axial load and means for holding the elastic column element under precompression in a first orientation, said means for holding the elastic column having said force-receiving surface and being responsive to said applied force on said force-receiving surface to further compress the elastic column into a buckled condition, and in which the stabilizing means includes at least one element which is positioned to apply said force to said force-receiving surface of the means for holding the elastic column element when the key top is depressed.

9. The key mechanism of claim 8 in which the elastic column element is a buckling compression spring and in which the means for holding the elastic column element under precompression comprises a first spring holder receiving a first end of the compression spring and a second spring holder receiving a second end of the compression spring, and in which the means for changing the relative orientation between the stabilizing means and the tactile feedback means comprises means for translating the first and second spring holders relative to said one element so that, in an inactive configuration of the key mechanism, said one element does not engage either of the spring holders.

* * * * *